United States Patent [19]

Hoeholt

[11] 4,129,332

[45] Dec. 12, 1978

[54] CHAIR MADE OF TWO PLATE-LIKE ELEMENTS

[75] Inventor: Steffen Hoeholt, Vordingborg, Denmark

[73] Assignee: Dehn Holding A/S, Alslev, Denmark

[21] Appl. No.: 824,545

[22] Filed: Aug. 15, 1977

[51] Int. Cl.[2] ..... A47C 7/00

[52] U.S. Cl. ..... 297/440; 297/443

[58] Field of Search ..... 297/18, 442, 440, 443

[56] References Cited

U.S. PATENT DOCUMENTS

| | | | |
|---|---|---|---|
| 2,830,656 | 4/1958 | Wagemans | 297/18 X |
| 2,914,117 | 11/1959 | Underwood | 297/18 X |
| 3,427,074 | 2/1969 | Whyte | 297/443 |
| 3,752,532 | 8/1973 | Yarus | 297/440 |
| 3,861,746 | 1/1975 | Skinner | 297/440 |

FOREIGN PATENT DOCUMENTS

| | | | |
|---|---|---|---|
| 314879 | 7/1956 | Switzerland | 297/118 |

*Primary Examiner*—James C. Mitchell

*Attorney, Agent, or Firm*—Frank R. Thienpont

[57] ABSTRACT

A chair consisting of two plate-like elements loosely connected together permitting of easy assembly and disassembly, one plate-like element providing a back portion, a leg portion and a support member for the second plate-like element, and said second plate-like element providing a seat portion and a leg portion.

7 Claims, 3 Drawing Figures

CHAIR MADE OF TWO PLATE-LIKE ELEMENTS

This invention relates to chairs and more particularly to a chair made of two plate-like elements which may be easily assembled and disassembled without the use of tools.

SUMMARY OF THE INVENTION

The principal object of this invention is to provide a chair made of two plate-like elements which can be easily assembled and disassembled without the use of tools.

Another object is to provide a chair which can be easily stored or transported due to its easy disassembly.

Another object is to provide a chair of two plate-like elements which are easily assembled into a strong and stable unit.

A still further object is to provide a chair according to the foregoing objects which is both comfortable and aesthetically pleasing.

Other objects and advantages of the invention will become more apparent when considering the following description and accompanying drawings.

DESCRIPTION OF PREFERRED EMBODIMENT

Figure 1:
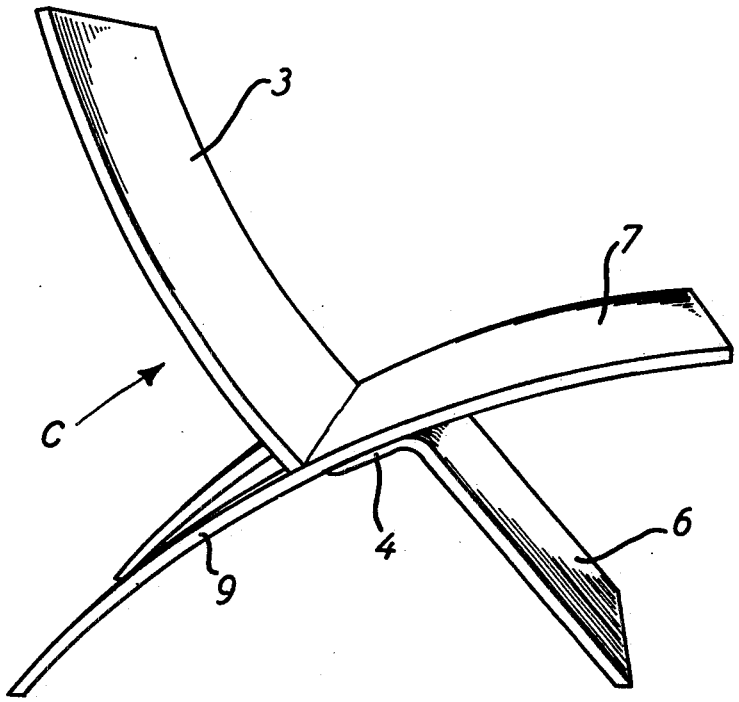
FIG. 1 is a perspective view of an assembled chair embodying the invention herein.
Figure 2:
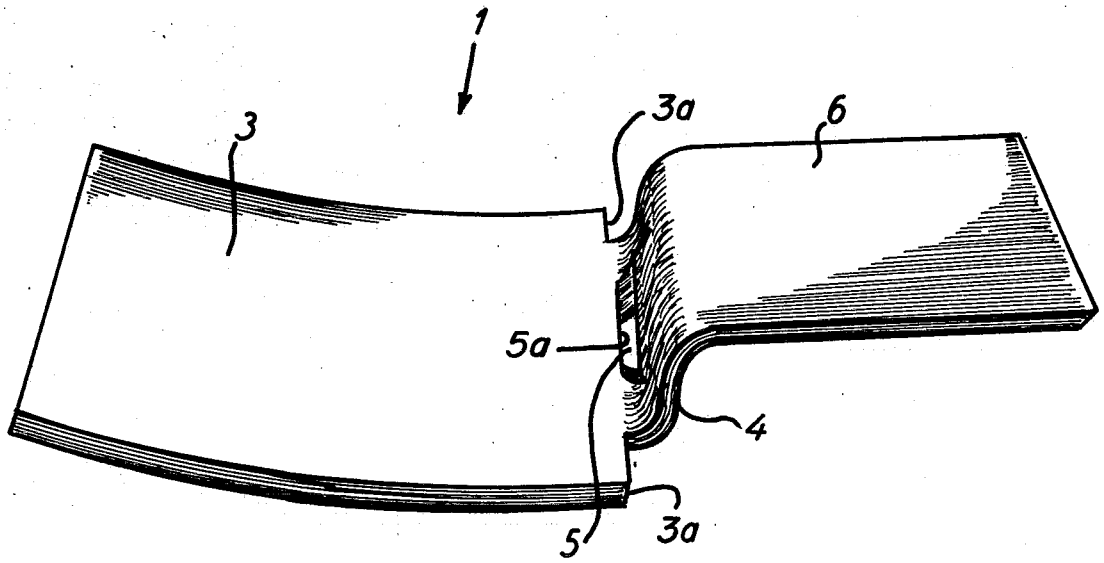
FIG. 2 is a perspective view of a plate-like member which is constructed to provide a back portion and a leg portion for the chair of FIG. 1.
Figure 3:
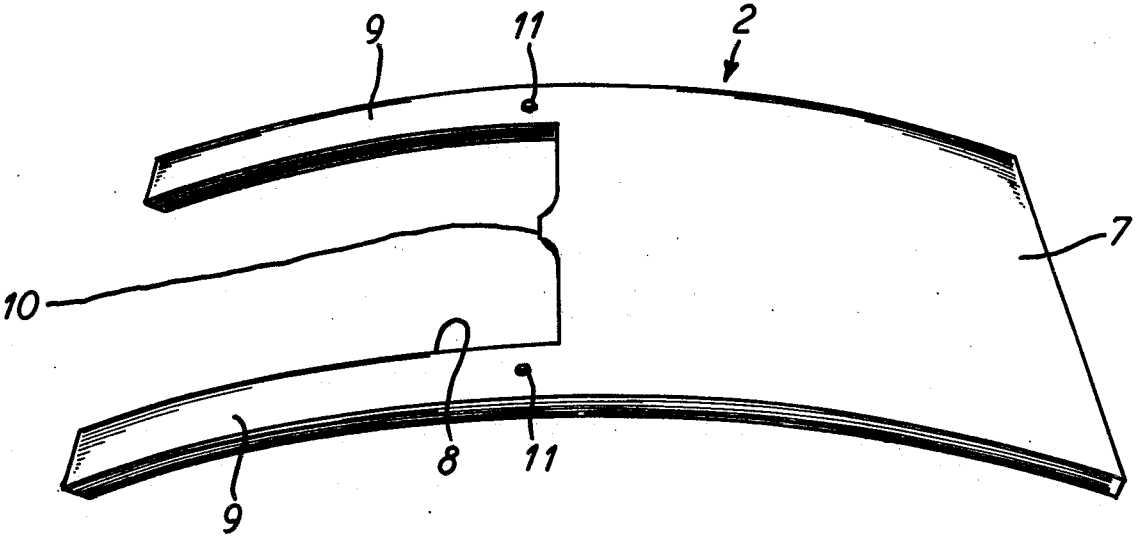
FIG. 3 is a perspective view of a plate-like member which is constructed to provide a seat portion and a leg portion for the chair of FIG. 1.

We refer now to the drawings wherein like reference characters in the several views indicate similar parts.

The chair C comprises two generally rectangular shaped plate-like elements 1 and 2 which may be assembled without tools. Element 1 comprises a rectangular concave back member 3 and a first leg member 6 which is substantially parallel to the back member 3 and interconnected therewith by a support member 4. The latter is formed substantially at right angles with the back member 3 for reasons which will become apparent. The width of the leg member 6 and support member 4 is smaller than the width of the back member 3. At the connection between the back member 3 and the support member 4 there is a centrally disposed longitudinal transversely extending opening 5 adapted to accept a projecting member formed on plate-like element 2, purpose of which will be explained.

The back member 3 preferrably has a slight concave shape to more easily act as a back supporting member and contribute to the overall comfort of the chair as well as to the aesthetics.

The plate-like element 2 preferrably has a slightly convex shape and comprises a seat member 7 and a pair of integrally formed leg members 9 formed at the outer edges of the long dimension of the element 2. The leg members 9 result, of course, from the formation of the cutout 8 which is, as shown, slightly wider than the supporting member 4 and leg member 6.

A tenon or projection 10 is formed at the rear edge of the seat member 7 and is adapted to be positioned in the opening 5 in element 1 when elements 1 and 2 are assembled into a chair.

A pair of projections 11 may be secured to each of the leg members 9 so that in the assembled chair construction they will bear against the rear side of back member 3 to lock the elements 1 and 2 together.

It will be observed in the assembled chair construction that the support member 4 functions as a pivotal support member. The lower edges 3*a* of the back member 3 and the upper side 5*a* of opening 5 function as reaction points for the contacting portions of element 2.

Elements 1 and 2 preferably are made from laminated wood which is easy to shape and at the same time provides sufficient strength, although other materials might be used such as plastic or even appropriately formed metal. The concavity of the back member 3 and the convex shape of element 2 contribute to the aesthetics of the construction.

The width of the back 3 and the seat 7 preferably is the same so that the chair will appear as shown in FIG. 1 after assembling the elements. It is apparent that the elements are steadied in a transverse direction because of the legs 9 which absorb the side strain and in the longitudinal direction by the action of the tenon 10 and projections 11 which securely lock the elements 1 and 2 in place.

In the disassembly process the seat 7 is lifted upwardly until the projections 11 are released from the edge of the back member 3 and the elements 1 and 2 are then pulled apart. The assembly process, of course, is merely a reversal of this procedure.

It will be apparent that I have advantageously provided an aesthetically appealing chair structure conveniently made of only two parts which are easily assembled and disassembled without tools. Furthermore, a chair of such a construction is easily stored and transported.

While a preferred embodiment of the invention has been disclosed, it will be appreciated that this is shown by way of example only, and the invention is not to be limited thereto as other variations will be apparent to those skilled in the art, and the invention is to be given its fullest possible interpretation within the terms of the following claims.

What is claimed is:

1. A chair assembly comprising:

first and second elongated plate-like elements;

said first elongated plate-like element including a back member, a first leg member laterally offset from said back member, and a support member for supporting said second plate-like element, said support member being integrally formed with and interconnecting with said back member and said first leg member, said back member at its interconnection with said support member being wider than said support member to thereby define at the lower edge of said back member at opposite sides and at the outer extremities thereof shoulder means to provide bearing points for portions of said second plate-like element in the chair assembly;

said second plate-like element including a seat member, a pair of leg members integrally formed with and as an extension of said seat member, said pair of leg members closely embracing said support member at each end of said support member, each of said leg members in the assembly bearing against said shoulder means, the rear portion of said seat member resting on said support member in the chair assembly; and locking means interengaging said first and second plate-like elements for locking said plate-like elements together in the assembly, said locking means comprising means formed on one of said first and second plate-like elements for engaging the other of said plate-like elements.

2. The chair assembly of claim 1 including means defining a projection formed on the rear edge of said seat member, and means defining an opening at the intersection of said back member and said support member for receiving said projection.

3. The chair assembly of claim 1 wherein said back and seat members are of substantially equal width.

4. The chair assembly of claim 1 wherein said pair of leg members are defined by a centrally disposed substantially rectangular cut-out portion running substantially one-half the length of said second plate-like element.

5. The chair assembly of claim 1 wherein said first and second plate-like elements are each made of laminated wood.

6. The chair assembly of claim 1 wherein said locking means comprises projection means formed on the upper side of said pair of leg members of said second plate-like member and adapted to engage said back member.

7. The chair assembly of claim 1 wherein said second plate-like member is convex in shape and said back member of said first plate-like member is concave in shape.

* * * * *